United States Patent [19]

Ishii et al.

[11] 4,081,499

[45] Mar. 28, 1978

[54] CARBURETOR WITH ELECTRIC HEATING TYPE AUTOCHOKE DEVICE

[75] Inventors: Makoto Ishii, Wako; Masahiko Iiyama, Tokyo; Masaaki Ozaki, Sayama, all of Japan

[73] Assignee: Honda Giken Kogyo Kabushiki Kaisha, Tokyo, Japan

[21] Appl. No.: 804,277

[22] Filed: Jun. 7, 1977

[30] Foreign Application Priority Data

Jun. 15, 1976 Japan ..... 41-69939

[51] Int. Cl.[2] ..... F02M 1/12

[52] U.S. Cl. ..... 261/39 E; 123/119 F; 236/101 C

[58] Field of Search ..... 261/39 E; 123/119 F; 236/101 C

[56] References Cited

U.S. PATENT DOCUMENTS

| | | | |
|---|---|---|---|
| 3,752,133 | 8/1973 | Irish et al. | 261/39 E |
| 3,806,854 | 4/1974 | Armstrong | 261/39 E |
| 3,980,065 | 9/1976 | Nomura | 261/39 E |

*Primary Examiner*—Tim R. Miles

*Attorney, Agent, or Firm*—Haseltine, Lake & Waters

[57] ABSTRACT

A hollow space of limited volume is defined in the central aperture formed through a heat-conducting plate, held in contact with a planar temperature-responsive resistance element, to receive the bimetal and heater supporting shaft. By varying the diameter and/or the length of the space, the rates of heat transmission from the heater to the bimetal and the resistance element can be properly correlated with each other so that any premature current control or overheating is effectively prevented.

3 Claims, 2 Drawing Figures

CARBURETOR WITH ELECTRIC HEATING TYPE AUTOCHOKE DEVICE

BACKGROUND OF THE INVENTION

This invention relates to carburetors provided with an electric heating type autochoke device.

In this type of autochoke device, it has previously been known to use a resistance element of positive temperature coefficient in order to detect any overheat state of the bimetal chamber and prevent the bimetal element from being excessively heated.

To serve this purpose, a definite correlation is required between the thermal deformation characteristic of the bimetal element under the effect of the electric heater means and the heater-current controlling characteristic of the resistance element, which is heated by the same electric heater means, and the relationship must be such that it is not until the bimetal is sufficiently deformed under heat to open the choke valve that the positive temperature coefficient resistance element acts to control the flow of heater current. Should the resistance element be heated enough to control the flow of heater current before the bimetal has been fully heated, the choke valve would not be fully opened owing to the insufficient deformation of the bimetal element. Contrariwise, if the amount of heat given to the resistance element be not enough to control the heater current even at the time when the bimetal element has been fully heated to open the choke valve, an excessive amount of thermal stress must develop in the bimetal. This has involved various problems such as deterioration of the bimetal and increase in electric power consumption, making it necessary to give special consideration to the location of the resistance element and its mounting relative to the heater means.

SUMMARY OF THE INVENTION

Accordingly, the present invention is intended to overcome the problems previously encountered as described above and has for its object the provision of a new and improved carburetor provided with an autochoke device of the general type described in which an enclosed hollow space is provided adjacent to the resistance element of positive temperature coefficient to serve as a heat transmission control means effective to properly correlate the rates of heat transmission to the bimetal and resistance elements.

The above and other objects, features and advantages of the present invention will be apparent from the following description when taken in conjunction with the accompanying drawing, which illustrates one preferred embodiment of the invention.

DESCRIPTION OF THE PREFERRED EMBODIMENT

Figure 1:
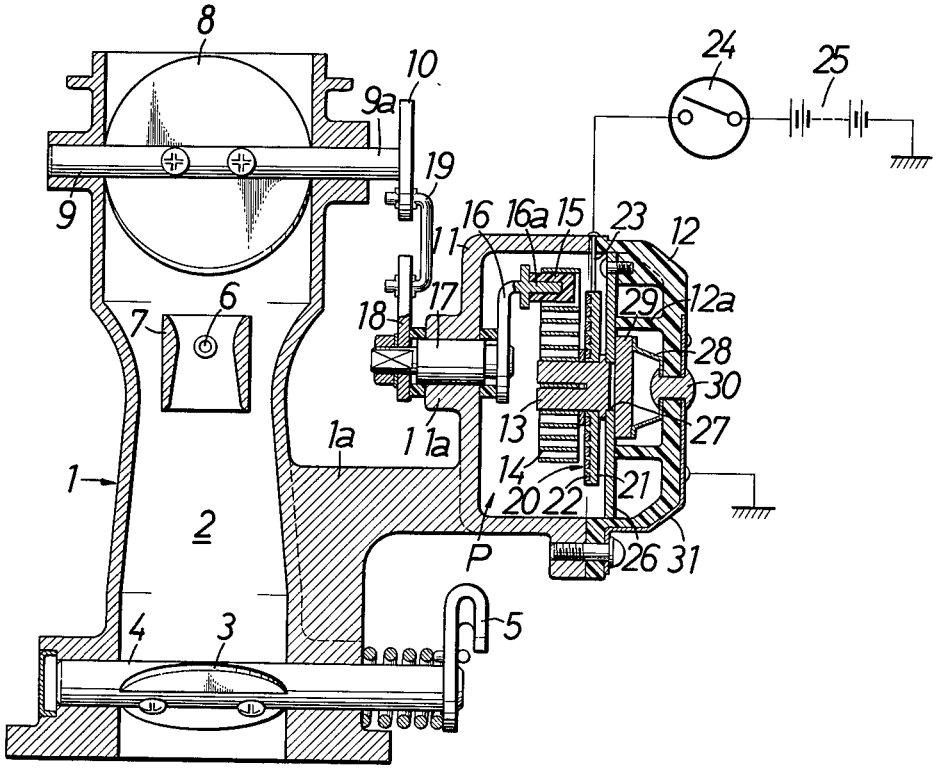
FIG. 1 is a partly schematic cross-sectional side elevation of a preferred form of carburetor embodying the present invention.

Referring to the drawing and first to FIG. 1, reference numeral 1 indicates the body of the carburetor illustrated, which includes a venturi passage 2 with a throttle valve 3 and a choke valve 8 arranged downstream and upstream thereof respectively. Provided between the two valves 3 and 8 is a minor venturi 7 in which a main fuel nozzle 6 is incorporated. The throttle valve 3 is fixedly mounted on a shaft 4 which is rotatably supported at one end on a side wall portion of the carburetor body 1 and extends at the other end exteriorly through the opposite side wall portion thereof. The external end of valve shaft 4 is connected through a lever 5 fixed thereto and appropriate cable and rod means with an accelerator lever or pedal, not shown, which is at the driver's disposal for adjustment of the throttle valve opening.

Similarly, the choke valve 8 is fixedly mounted on another shaft 9, which is also journalled at one end on a side wall portion of the carburetor body 1 and extends at the other end exteriorly through the opposite side wall portion thereof. A choke lever 10 is fixed to the extended end **9*a* of the shaft 9**.

On that side of the carburetor body 1 through which the valve shafts 4 and 9 extend exteriorly thereof, a bracket arm **1*a* is formed integral with the carburetor body 1 on an intermediate portion thereof and a bimetal housing or casing 11 is formed on the bracket arm 1*a* integrally therewith. As shown, the body of casing 11 is open at its outer end and capped with a cup-shaped cover member 12**, made of an appropriate insulating material, to define an enclosed bimetal chamber P.

Fixedly arranged in the bimetal chamber P is a support shaft 13 formed of electrically conductive material and, as shown, a spiral form of bimetal strip 14 is fixed at its base end to the inner end of the support shaft 13. The bimetal element 14 is operatively connected at the other end with the bent end portion **16*a* of an L-shaped operating lever member 16 through the medium of a collar 15 of insulating material, which is fitted over the lever end 16*a*. A motion-transmitting shaft 17 is provided on the casing 11 which extends through the casing bottom or wall opposite to the cover 12 with the lever 16 fixed to that end of shaft 17 which extends into the bimetal chamber P. The other end of motion-transmitting shaft 17 which extends exteriorly of the bimetal chamber P is connected with the choke lever 10 by way of a lever arm 18 fixed to the shaft end and a connecting link 19**.

Figure 2:
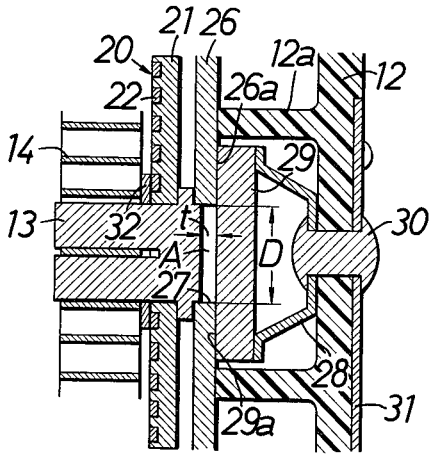
FIG. 2 is an enlarged illustration of a portion of FIG. 1, showing essential parts of the embodiment.

An electric heater disc 20 is fixedly fitted at its center over the support shaft 13 intermediate the ends thereof in a manner such that the heat-producing surface of the disc 20 is held opposite to the adjacent side of bimetal element 14. As shown in FIG. 2, an electrically conductive terminal plate 32 is also fitted over the support shaft 13 between the bimetal element 14 and the electric heater disc 20 to define a definite distance therebetween. The heater disc 20 is comprised of a circular disc plate 21 formed of a highly heat-resisting insulator material such as ceramic and a heater element 22 provided on that surface of the disc plate 21 which is adjacent to the bimetal element 14. The heater element 22 is electrically connected at one end to the support shaft 13 through the medium of terminal plate 31 and at the other end to a source of voltage supply 25 through the medium of a terminal provided on the heater disc 20 at a peripheral edge thereof and an ignition switch 24.

The casing cover 12 of insulating material is cup-shaped, bulging exteriorly, and in which a heat-conducting plate 26 is secured by screw means to the peripheral wall portion of the cup-shaped cover 12. The heat-conducting plate 26 is formed of an electrically conductive material having a good thermal conductivity and, as will be described later, serves as a mounting bracket for the bimetal and heater elements. The casing cover 12 is formed centrally thereof with an axially inwardly extending annular projection 12*a* which is held in abutting engagement with the adjacent surface of the heat-conducting plate 26 to serve the purpose of supporting the radially intermediate portion thereof. Formed in the center of the heat-conducting plate 26 is a supporting aperture 27 in which the support shaft 13 is fixedly fitted at its base end. In this manner, the support shaft 13 is held in place by the heat-conducting plate 26 and the central aperture 27, extending through the plate 26, is closed at one end by the base end of support shaft 13.

In the space within the annular projection 12*a* of casing cover 12 is supported a planar form of resistance element 29 by means of a resilient supporting member 28. The resistance element 29, in this embodiment, has a positive temperature coefficient and the resistance value of which increases with rise in temperature. As observed clearly in FIG. 2, that surface of the resistance element 29 which is adjacent to the heat-conducting plate 26 is held in contact with the adjacent side surface 26*a* thereof under the resiliency of supporting member 28, as indicated at 29*a*, and the central aperture 27 in heat-conducting plate 26 is closed at the other end by the adjacent surface of the resistance element 29. As shown, in the central supporting aperture 27 is defined by the opposing faces of the support shaft 13 and resistance element 29 a hollow space or chamber A of limited volume which is effective to control heat transmission to the resistance element 29. It will be obvious that the volume of hollow chamber A is determined by the diameter D of the aperture 27 and the distance *t* between the support shaft 13 and the resistance element 29.

The resistance-element supporting member 28 is formed of an electrically conductive resilient material and serves to urge the resistance element 29 inwardly against the heat-conducting plate 26 to hold their contacting surfaces 29*a* and 26*a* in pressure contact with each other. Also, the supporting member 28 is secured to the casing cover 12, for example, by means of a rivet 30 made of an electrically conductive material. As illustrated, the rivet 30 is also utilized as a means for securing a terminal plate 31 to the outside surface of cover 12. The terminal plate 31 is grounded, as shown, to complete a heater circuit which includes voltage source 25, ignition switch 24, terminal 23, heater 22, support shaft 13, heat-conducting plate 26, resistance element 29, supporting member 28, rivet 30 and terminal plate 31.

With the device described, when the ignition switch 24 is turned on to close the heater circuit, the heater 22 is energized to produce heat so that the bimetal 14 is heated to deform and thus acts to turn the shaft 9 through the medium of operating lever 16, motion-transmitting shaft 17, lever 18, link 19 and lever 10 in a direction to open the choke valve 8.

The heat produced on the heater disc 20 is transmitted not only to the bimetal element 14 but also to the resistance element 29 and the heat transmission to the latter is effected through the support shaft 13 and heat-conducting plate 26 and also directly by heat radiation from the support shaft 13. In this manner, the resistance element 29 is caused to rise in temperature by heat conduction and radiation thereto. In this connection, it is to be noted that heat transmission to the support shaft 13 is effected directly from the heater 22 and bimetal 14 and that to the heat-conducting plate 26 is effected by radiation from the heater disc 20 and support shaft 13 as well as by conduction through the latter. Apparently, the resistance element 29, through which current is being directed, is also caused to rise in temperature under the Joule heat evolving in itself.

It is an important feature of the structure described that the amount of heat transmitted ultimately to the resistance element 29 is controllable owing to the provision of an enclosed space or hollow chamber A in the heat-conducting plate 26, as the rate of heat conduction from the heat-conducting plate 26 to the resistance element 29 and that of heat radiation to the latter from the support shaft 13 can be adjusted as desired simply by varying the diameter D and/or the length *t* of the hollow chamber A.

As will readily be appreciated from the foregoing description, the device of the present invention has the advantage that the thermal deformation characteristic of the bimetal element and the current controlling characteristic of the resistance element can be readily correlated as desired for optimal carburetor operation.

What is claimed is:

1. A carburetor including a choke valve arranged in the intake duct thereof and provided with an electric heating type autochoke device, comprising a casing fixed to the body of the carburetor, a bimetal element accommodated in said casing and operatively connected with said choke valve so as to open the latter as said bimetal element is deformed under heat, an electric heater disc arranged in said casing in spaced opposite relation to said bimetal element and adapted to be supplied with electric current from a source of electric voltage during engine operation, a heat-conducting plate fixedly secured to said casing in a position adjacent to said electric heater disc on the side thereof remote from said bimetal element, and a resistance element having a positive temperature coefficient supported on the side of said heat-conducting plate remote from said electric heater disc and inserted in the heater circuit in series with said electric heater disc, said heat-conducting plate and said resistance element being formed to define therebetween a hollow chamber of limited volume effective to control heat transmission to said resistance element.

2. A carburetor as claimed in claim 1, further comprising a support shaft on which said bimetal element is fixedly supported at one end thereof and a supporting aperture formed through said heat-conducting plate and closed at one end by said support shaft partly fitted therein and at the other end by said resistance element to define said hollow chamber in said heat-conducting plate between said support shaft and said resistance element.

3. A carburetor as claimed in claim 1, in which the free end of said bimetal element is operatively connected with an operating member, associated with said choke valve, through the medium of an insulator member.

* * * * *